US007635218B1

(12) United States Patent
Lott

(10) Patent No.: US 7,635,218 B1
(45) Date of Patent: Dec. 22, 2009

(54) METHOD FOR DUST-FREE LOW PRESSURE MIXING

(75) Inventor: William Gerald Lott, Houston, TX (US)

(73) Assignee: Vortex Systems (International) CI, Grand Cayman (KY)

( * ) Notice: Subject to any disclaimer, the term of this patent is extended or adjusted under 35 U.S.C. 154(b) by 0 days.

(21) Appl. No.: 12/487,065

(22) Filed: Jun. 18, 2009

Related U.S. Application Data

(63) Continuation-in-part of application No. 12/176,540, filed on Jul. 21, 2008, which is a continuation-in-part of application No. 11/737,690, filed on Apr. 19, 2007, now Pat. No. 7,401,973.

(51) Int. Cl.
*B01F 15/02* (2006.01)

(52) U.S. Cl. ..... 366/159.1; 366/163.2; 366/349

(58) Field of Classification Search ..... 366/163.2, 366/163.1, 159.1, 165.1, 165.2, 101, 106, 366/107, 348; 55/385.1; 137/544
See application file for complete search history.

(56) References Cited

U.S. PATENT DOCUMENTS 4,527,716 A 7/1985 Haas et al.
5,020,858 A 6/1991 Nishikawa
5,382,411 A 1/1995 Allen
5,447,394 A 9/1995 Shepard
5,507,237 A 4/1996 Barrow et al.
5,642,939 A 7/1997 Comardo
5,664,733 A 9/1997 Lott
5,722,552 A 3/1998 Olson
6,024,874 A 2/2000 Lott
6,223,903 B1 5/2001 Mansouri
6,357,906 B1 3/2002 Baudoin et al.
6,796,704 B1 9/2004 Lott
7,048,432 B2 5/2006 Phillippi et al.
7,401,973 B1 7/2008 Lott
2005/0058020 A1 3/2005 Lott
2005/0111298 A1 5/2005 Lott

FOREIGN PATENT DOCUMENTS

GB 2123789 2/1984

*Primary Examiner*—Tony G Soohoo
(74) *Attorney, Agent, or Firm*—Buskop Law Group, PC; Wendy Buskop

(57) ABSTRACT

A method for dust-free low pressure mixing for conveying and mixing secondary dry and secondary liquid components into a primary liquid component with a hermetically sealed system, the method comprising: using a cyclone separator to capture dust from a surge tank and form a recovered product, using a flow promoter to prevent bridging an rat-holing, pressurizing an eductor to draw dry components into a mixing chamber, fluidizing the dry component, and expelling the fluidized dry component.

10 Claims, 15 Drawing Sheets

METHOD FOR DUST-FREE LOW PRESSURE MIXING

CROSS REFERENCE TO RELATED APPLICATIONS

This application is a Continuation in Part Application of Co-pending U.S. patent application Ser. No. 12/176,540 filed on Jul. 21, 2008, entitled "Dust-Free Low Pressure Mixing System with a Jet Ring Adapter", which claims priority to 11/737,690, filed on Apr. 19, 2007, entitled "Dust-Free Low Pressure Mixing System". Application Ser. No. 11/737,690 has issued as U.S. Pat. No. 7,401,973 on Jul. 22, 2008. These Applications are hereby incorporated in their entirety, the disclosures of which are herein incorporated by reference.

FIELD

The present embodiments generally relate to a method for closed, high-velocity mixing of drilling fluids which include fluidizable particulate.

BACKGROUND

The mixing of liquids with particulates needs to be done with a dust-free low pressure mixing method in order to prevent explosions of dust and to prevent unhealthy particles from entering the breathing space of workers. The flow of the liquid during mixing needs to be turbulent to ensure that the particulates are sufficiently blended to create a complete mixture of the particulates and the liquid.

Traditional mixing of barite or, in some cases, bentonite, generates air borne dust when chemical surge tanks are used for mixing. Conveyance of bentonite or barite through a conduit and into a surge tank can be a toxic hazard for workers, and the conduit and surge tank need to be hermetically sealed to prevent contaminates and other toxic materials from escaping. The airborne dust is harmful to workers, particularly those with breathing problems, and is also harmful to equipment, for example the dust can clog equipment. There exists a need for a method of mixing that is dust-free and generally safer than known methods for mixing.

The present embodiments meet these needs.

BRIEF DESCRIPTION OF THE DRAWINGS

The detailed description will be better understood in conjunction with the accompanying drawings as follows.

Figure 1:
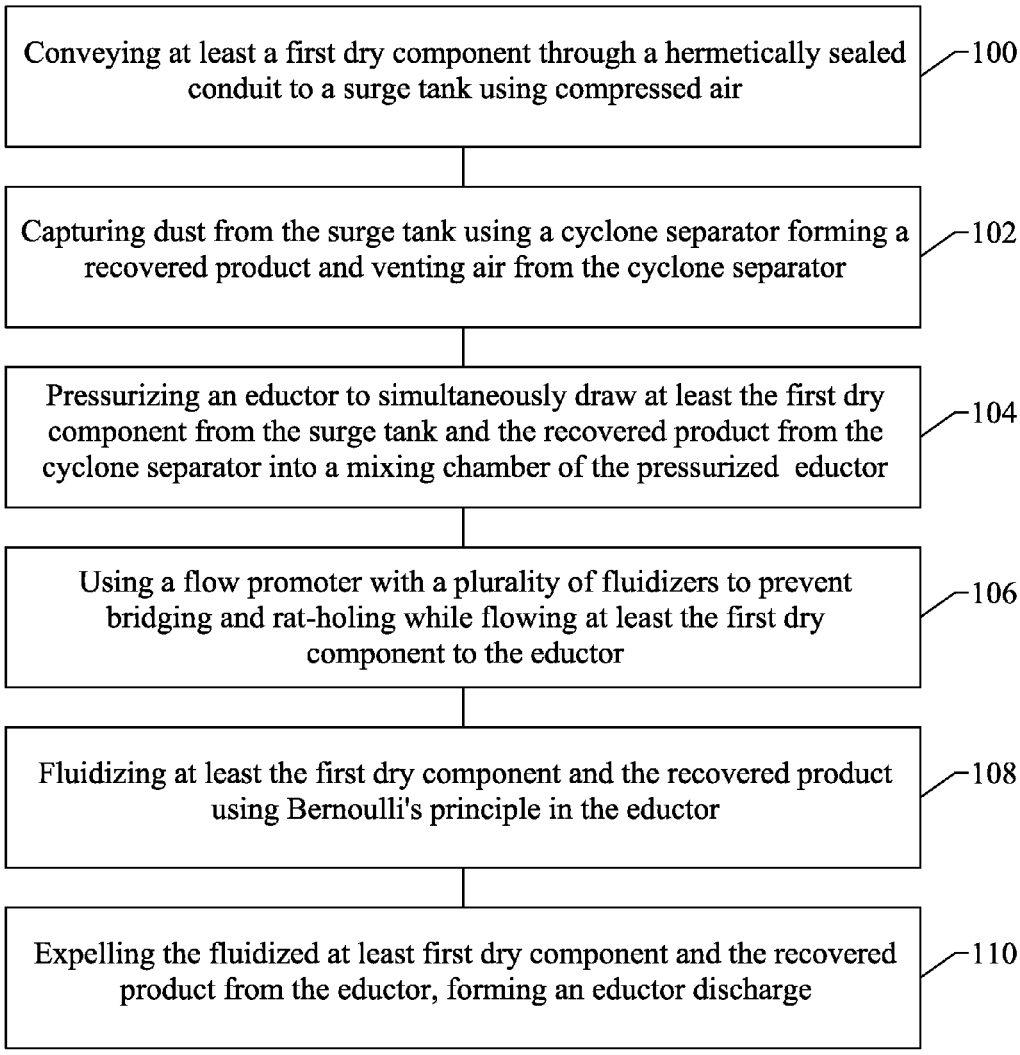
FIG. 1 depicts a flow chart of the steps of a dust free low pressure mixing method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The method relates to a dust-free low pressure mixing method for use with drilling fluids. Embodiments of the dust-free low pressure mixing method provide an environmentally friendly mixing method by reducing the dust from dry components. The embodiments of the dust-free low pressure mixing method are capable of eliminating dust because the dry components are in hermetically sealed conduits from a storage silo to a surge tank, from the surge tank to an eductor, and from an air cyclone to the eductor. The present method can be used for mixing drilling fluids, drilling muds, or cement.

The method can include the step of pneumatically conveying a first dry component, such as barite or bentonite, from a silo and into a surge tank using compressed air. As much as 1 metric ton of barite per minute can be mixed.

The method can also include the step of capturing dust that has been generated through pneumatically conveying the first dry component from the silo to the surge tank using a cyclone separator. The cyclone separator can separate the dust from the clean air. The dust is considered a "recovered product" which can be introduced into an eductor usable in the method as a usable product while simultaneously venting the clean air from the cyclone separator.

Next, the method can include the step of pressurizing the eductor to simultaneously draw at least the first dry component from the surge tank, a hopper or combinations thereof, to a mixing chamber of the eductor.

The method can further include the step of using a flow promoter with a plurality of fluidizers to prevent bridging and rat-holing while flowing the first dry component to the eductor.

The first dry component can be fluidized using Bernoulli's principle in the eductor. The fluidized first dry component can then be expelled.

The eductor usable in this method can be a union of a mixing chamber, a motive nozzle and a diffuser, which can be a Venturi/diffuser, in a housing with one or more induction ports for receiving at least the first dry component, a second dry component, and a third component. The third component can be a liquid or a dry component such as a powder, or can be the recovered product described above. In an embodiment, the induction ports are generally perpendicular to the motive nozzle. The motive nozzle can have a non-circular, symmetrical lobe-shaped orifice disposed axial to the diffuser portion of the eductor.

A first induction port disposed on the eductor can be for flowing the first dry component into the mixing chamber. A second induction port can be for flowing the second dry component into the mixing chamber. A third induction port can be for flowing the third component into the mixing chamber.

The induction ports can further be used to receive a caustic soda or an emulsifier for additional mixing.

An inlet can be disposed on the eductor in fluid communication with the mixing chamber of the eductor for flowing a motive pressurized fluid through the motive nozzle disposed in the inlet of the eductor, and into the mixing chamber. The motive pressurized fluid can be directed through the motive nozzle of the eductor to produce a high-velocity stream. The high-velocity stream generates a low pressure region within the eductor. The low pressure region will then entrain the first, second, and/or third components through the first, second, and/or third induction ports. The first dry component, second dry component, and/or the recovered product can be mixed in the low pressure mixing region in the eductor. After mixing, the components can be expelled from the eductor as an eductor discharge.

It is contemplated that the low pressure region can generate a near-perfect vacuum when the motive pressurized fluid is traveling at a minimum of about 60 feet per second. The first dry component can be drawn from first dry component source, which can be the surge tank. The second dry component can be drawn from a hopper. The third component can be either a recovered product from the cyclone separator, a silo, a liquid caustic soda, or a liquid emulsifier. The principal design of this system is according to the Bernoulli principle.

In an embodiment, the first dry component from the surge tank can be prewetted before being drawn into the eductor. In an embodiment, the surge tank and the hopper can be parabolic in shape.

In an embodiment, a vacuum gauge can be in communication with the induction ports for indicating the vacuum within the eductor.

When the eductor discharge, which can be a uniform mixed slurry, exits the eductor, the eductor discharge can have a pressure recovery of at least about 50 percent of the motive pressurized fluid relative to when the motive pressurized fluid entered the inlet. The pressure recovery can range between about 50 percent to about 80 percent of the pressure of the motive pressurized fluid upon entering the inlet.

The eductor, as described, can be capable of mixing at least 1 metric ton of barite per minute, and can range up to about 3 metric tons per minute. This method allows for rapid increase in drilling fluid density while drilling in high pressure formations. This method thereby reduces the costs associated with man-hours, and other operation costs while drilling, thereby making drilling operations more profitable.

The embodiments of the eductor and its associated components can be used in a closed mixing method for fluidizing dry components or powders, or can be used for mixing at least two separate components together wherein one of them can be a liquid.

In an embodiment of the present method, the mixing can be a continuous mixing of one or more separate components together, such as mixing of a powder, a granular material or a liquid. The liquid can be a drilling fluid slurry. The particulate can be barium sulfate or bentonite.

It can be contemplated that the mixing can form a uniformed mixed slurry. The term "uniform mixed slurry" can be referred to herein as including granular materials, powdered materials, and other soluble materials.

In an embodiment, the eductor can engage a premixer, the premixer can generate a strong vortex that pre-wets the first or the second dry component as it is introduced into the eductor.

The generated vortex pre-wets the first or second dry component because of the rotational energy imparted on the first or second dry component. The generated vortex changes momentum into centrifugal force and causes the rotating stream to have at least two velocity components: (a) axial velocity and (b) radial velocity.

The generated vortex imparts momentum to particles, thereby causing the particles to accelerate and centrifugally separating the particles. The generated vortex can impart enhanced interfacial contact between a first and second dry components and a optionally a liquid, forming a uniform mixture due to stretching, shearing, and folding of first and second dry components.

It can be noted that the eductor provides a passive method of energizing the fluid boundary layer in a conically shaped diffuser, providing a method to reduce viscous drag with a diffuser having a short throat as well as a method that generates a vacuum with a pressurized motive fluid velocity of about 60 feet per second and an operating pressure drop of about 25 psi.

As noted above, the dust-free low pressure low pressure mixing method can use a cyclone separator in communication with the third induction port, and attached to the surge tank proximate to the vent. The cyclone separator can have a body with an inlet port for receiving dust from the surge tank, and can further have a vent that releases air. The cyclone separator prevents hazardous and toxic dust from entering the air and produces a recovered product that would otherwise be waste. The cyclone separator therefore enables for safer and more efficient mixing of components.

The third induction port can accommodate both a liquid and/or a recovered product from the cyclone separator. The third component can be liquid chemicals, such as caustic soda, emulsifiers, and substantially similar chemicals. The cyclone separator can have an outer housing which includes a volute feed inlet, a cylindrical section in communication with the volute feed inlet, a cone section in communication with the cylindrical section, a vortex finder (overflow), and a discharge (underflow). The discharge has a discharge nozzle in the cyclone separator that defines a circular central region having a laterally extending opening with a cone shape.

The cyclone separator can have a stabilizer secured to the entrance to the vortex finder. The stabilizer is used to stabilize the air in the core and to prevent short circuiting large particles from being removed through the vortex finder.

Dust can be separated from the expanding air in the cyclone separator and discharged through the discharge as the recovered product. Clean air is discharged through the vortex finder.

The method can include the use of a flow promoter, which can be a one piece insert having a plurality of fluidizers that can be connected to the apex of the surge tank. The apex can be the discharge of the surge tank.

The flow promoter allows the more efficient flow from the surge tank to the eductor. The flow promoter reduces stress at the discharge of the surge tank, preventing product plugging and rat-holing.

The flow promoter with the plurality of fluidizers can have a flow promoter body. The flow promoter body can have a cavity core, an inlet end, an outlet end, and a central axis.

The plurality of fluidizers can each be made of urethane and can have a stem for flowing compressed air to a flexible disc that covers the outlet from the stem. The stem is secured to one of the converging ridges opposite a lobe.

The disc can be positioned over the opening of the stem. The stem can have at least one stem nozzle, and up to four stem nozzles for converting pressurized air into at least one high velocity stream, for lifting a flexible lip of the disc that allows compressed air to flow into at least one air chamber of the flow promoter.

The stem can be secured to an outer wall of the flow promoter with a fastener, and the disc can be held down over the opening of the stem with another fastener that ensures compressed air only passes under the lip of the disc to the cavity of the flow promoter, ensuring free flowing of the first dry component.

In an embodiment of the dust-free low pressure mixing method, a connecting conduit with a clear segment can be disposed between the flow promoter and the eductor. The clear segment can have a sight-glass or can be a sight glass for viewing the flow of the first dry component.

In the present embodiment of the dust-free low pressure mixing method, the premixer can be in fluid communication with the first induction port. The premixer can be disposed between the first dry component source, and the first induction port for generating a vortex to optionally pre-wet and hydrate the first dry component.

A diverter manifold can be used for flowing motive pressurized fluid from the eductor to the premixer. The premixer can be beneficial when the second dry component is a chemical, such as a polymer, because it allows for polymer dissolution without clumps, "fish eyes", or microgels. "Fish eyes" occur when portions of a dry component are not completely hydrated.

The second dry component source can be a hopper with a bag slitter and a conveyor table. In an alternative embodiment of the hopper, the hopper can be equipped with a the table. It is not necessary that the hopper have both the table and the bag slitter.

The hopper can also have a bag slitter insert disposed within a bowl shaped interior cavity of the hopper which can be parabolic in shape. The bag slitter can have a substantially hollow central cavity in fluid communication with the eductor. The hollow central cavity allows the second dry component to be drawn or sucked through one of the second induction port into the eductor in a substantially dust-free manner.

The second dry component can be fed in a substantially dust-free manner due to the bag containing the second dry component conforming to the shape of the bowl shaped interior cavity, and generating a soft seal between the interior cavity of the hopper and the bag.

It can be contemplated that in an embodiment of the dust-free low pressure mixing method, a first flow valve, such as a butterfly valve, can be disposed between the apex of the hopper and the premixer. A second flow valve can be disposed between the second induction port of the eductor and the flow promoter. The first and second flow valves can be adjusted to allow more than one dry component to flow to the eductor simultaneously.

A third flow valve can be disposed on the housing of the eductor between the mixing chamber and an outside supply in fluid communication with the third induction port of the eductor. The third flow valve can be used to control the flow of the third component through the third induction port.

An alternate type of fluidizer can be disposed between the flow promoter and one of the induction ports. This alternate type of fluidizer can have a concentric reducer. The concentric reducer can have an air supply port. The air supply port can receive pressurized air. The concentric reducer can have an interior concentric cavity for receiving a flexible fluidizer insert. This alternate type of fluidizer, herein termed "the large fluidizer" can have a flexible insert typically made of urethane or an elastomer, with a groove formed into the outer surface of the flexible insert.

The groove can be at an elevated position relative to the air supply port. The flexible fluidizer insert can be made out of urethane, rubber, various other flexible polymers, or another flexible material. The large fluidizer housing can be made out of a non-flexible material such as urethane, carbon steel, urethane pipe, or stainless steel.

In operation, the pressurized air flows to the groove causing the flexible fluidizer insert to vibrate and flutter against the nonflexible material.

As the flexible fluidizer vibrates and "flutters", a sheet of air is created with the large fluidizer to fluidize the dry component and unclog any bridging material by increasing fluidity of the powder. The fluidization of the dry component causes the dry component to flow like a fluid. The dry component flowing like a fluid prevents clogs as the dry component traverses from the silo to the eductor.

The fluidizer can be selectively activated to break up clogs as they form due to clumping of the dry component.

In an embodiment of the dust-free low pressure mixing method, the eductor, silo, flow promoter with plurality of fluidizers, large fluidizer with flexible insert, connecting conduit, premixer, diverter manifold, and the cyclone separator can be integrally connected as a closed system and hermetically sealed. The closed system allows mixing and dispersion of a uniformly blended mixture in a dust-free manner. The present embodiments of the invention can be better understood with reference to the figures.

FIG. 1 depicts the steps of the dust-free low pressure mixing method as a flow chart.

Step 100 includes pneumatically conveying a first dry component, such as barite or bentonite, into a surge tank using compressed air.

Step 102 involves capturing dust that has been generated through pneumatically conveying the first dry component into the surge tank using a cyclone separator. The cyclone separator separates the dust from the clean air. The dust is considered a "recovered product" which can be reintroduced into the eductor as a usable product while simultaneously venting clean air from the cyclone separator.

Step 104 involves pressurizing the eductor to simultaneously draw at least first dry component from the surge tank, a hopper or combinations thereof, and the recovered product, into a mixing chamber of the pressurized eductor.

Step 106 involves using a flow promoter with a plurality of fluidizers to prevent bridging and rat-holing while flowing the first dry component to an eductor.

Step 108 involves fluidizing the at least first dry component and the recovered product using Bernoulli's principle in the eductor.

Step 110 involves expelling the fluidized at least first dry component and the recovered product, forming an eductor discharge.

Figure 2:
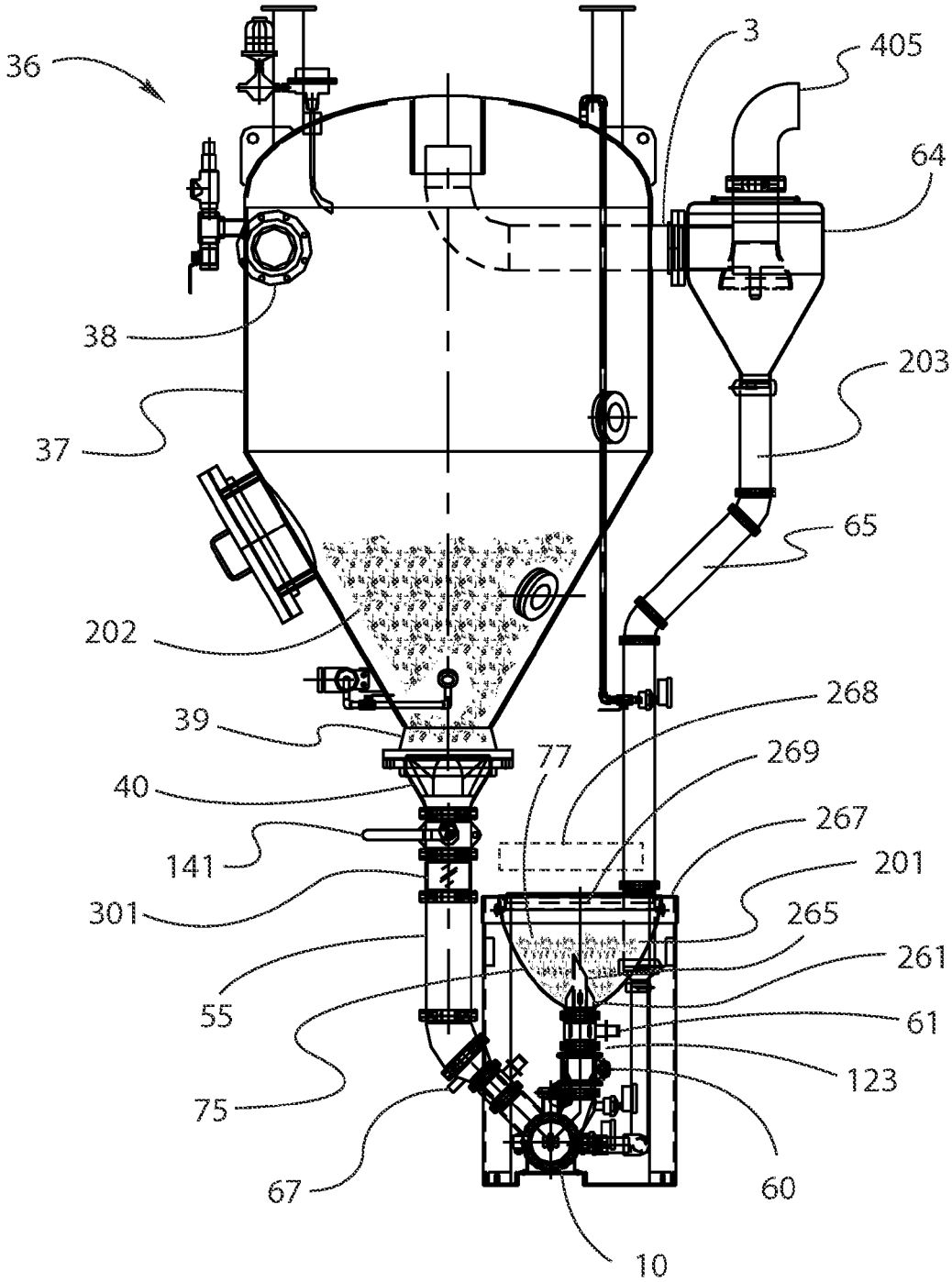
FIG. 2 depicts a schematic view of a dust-free low pressure mixing system usable with this method.

FIG. 2 depicts a schematic view of a dust-free low pressure mixing system usable with this method.

The method can be useable on a dust-free low pressure mixing system having a surge tank 36. The surge tank 36 can have a capacity of at least 50 cubic feet, a net weight of at least 4000 pounds, and a height of at least 120 feet. Compressed air can be used to move dry components into the surge tank 36 from a storage silo.

The surge tank 36 can further have a body 37. The body 37 can be made of steel, aluminum, or other weldable similar materials. The body 37 can also have an inlet port 38, for receiving bulk material, for example the inlet port 38 can receive bulk material using a pneumatic system connected to another storage silo.

The body 37 can be connected to a discharge segment 39. The discharge segment 39 can be conical or dish shaped.

The surge tank 36 further includes a vent 3, located proximate to the top of the body 37. The vent 3 can be a cavity formed into the body 37, with a connection port. The vent 3 can be screened or unscreened. The inner diameter of vent 3 can range from about 3 inches to about 12 inches.

A flow promoter 40 promotes "mass flow" from the surge tank 36. The flow promoter 40 prevents dry components from bridging and rat holing. Flow promoter 40 reduces the circular stress at the discharge segment 39 causing free flowing of dry components.

A valve 141, such as a butterfly valve, is depicted connected to the flow promoter 40. The valve 141 controls the flow of a first dry component 202 out of the flow promoter 40.

The first dry component 202, for example, can be pneumatically transferred from a large storage silo on a drilling rig to the surge tank 36.

The valve 141 can be connected to a connecting conduit 55 which can optionally have a sight glass 301 disposed between the flow promoter 40 and an eductor 10 for viewing the flow of the first dry component 202. The sight glass 301 allows for identification of flow problems.

FIG. 2 further shows a large fluidizer 67 that can be activated when there are flow problems. The large fluidizer 67, which can be a fluidizer retrofit, is depicted disposed between the flow promoter 40 and the eductor 10.

A cyclone separator 64 can be connected to the surge tank 36 proximate to, and in fluid communication with the vent 3. The cyclone separator 64 can be a Spintop Cyclone®, manufactured by Vortex Ventures, Inc., of Houston, Tex. The operation of the Spintop Cyclone® is defined in U.S. Pat. No. 6,024,874, which is incorporated herein by reference.

The cyclone separator 64 prevents dust from escaping through the vent 3. The cyclone separator 64 exhausts clean air through outlet 405 into the environment, while simultaneously recycling the dust and converting the dust into a recovered product. Recovered product 203 is shown to be disposed within a conduit 65 and in fluid communication between the eductor 10 and the cyclone separator 64.

A hopper 75 is depicted with a bowl shaped inner cavity 77. The bowl shaped inner cavity 77 has a bag slitter 265 secured to the center of the bowl shaped inner cavity 77. The bag slitter 265 can be made out of steel, stainless steel, or another substantially hard material. The bag slitter 265 is depicted having a substantial hollow inner cavity 261 in fluid communication with the eductor 10.

The hopper 75 is also depicted in this embodiment with a table 267 which has conveyor rollers 269. The table 267 and conveyor rollers 269 allow for easy transportation of bags 268 to the bowl shaped inner cavity 77.

A second valve 61 is depicted disposed between the hopper 75 and a premixer 60. A conduit 123 connects the second valve 61 to the premixer 60. The second valve 61 can be a butterfly valve. The second valve 61 can be adjusted along with the first valve 141 to allow for simultaneous flow of first and second dry components (201 and 202).

The premixer 60 can be a Vortex Premixer Model V V-PMB-4-UT, manufactured by Vortex Ventures, Inc. of Houston, Tex. and described in U.S. Pat. No. 6,796,704, which is incorporated by reference herein, and is an annular jet pump device used in mixing applications to ensure complete mixing of liquids and chemicals, such as polymers, starches, and clays.

The premixer 60 is disposed between an induction suction port of the eductor 10 and the hopper 75. The optional step of pre-wetting the second dry component can be achieved with the premixer 60.

Figure 3A:
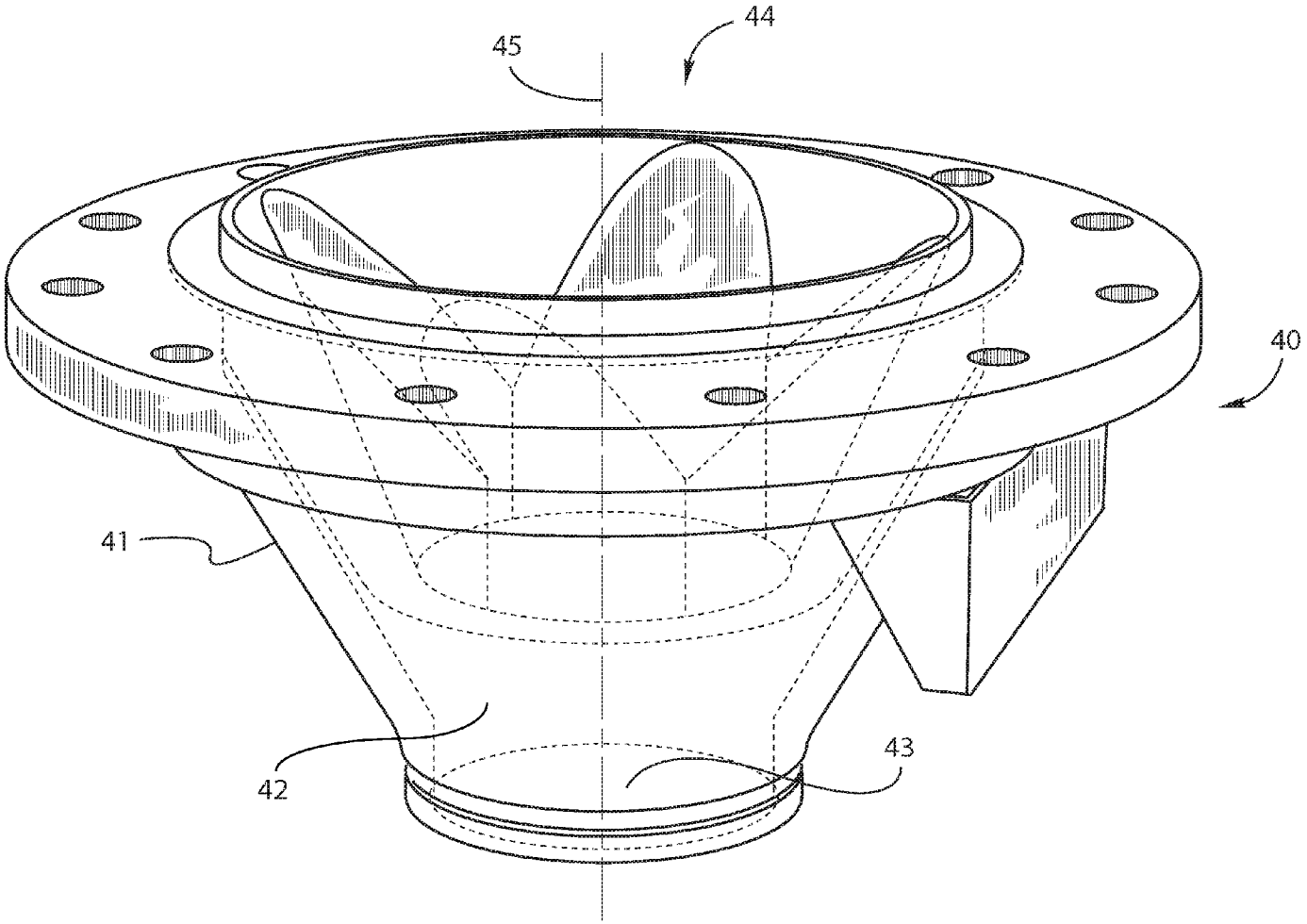
FIG. 3A depicts a perspective view of a flow promoter usable with this method.

FIG. 3A depicts a perspective view of a flow promoter usable in the present method. Flow promoter 40 has a flow promoter body 41. The flow promoter body 41 is depicted having a cavity core 42, an outlet end 43, an inlet end 44, and a central axis 45. The cavity core 42 is oriented parallel with the directional force of the first dry component 202 flowing from the surge tank 36.

Figure 3B:
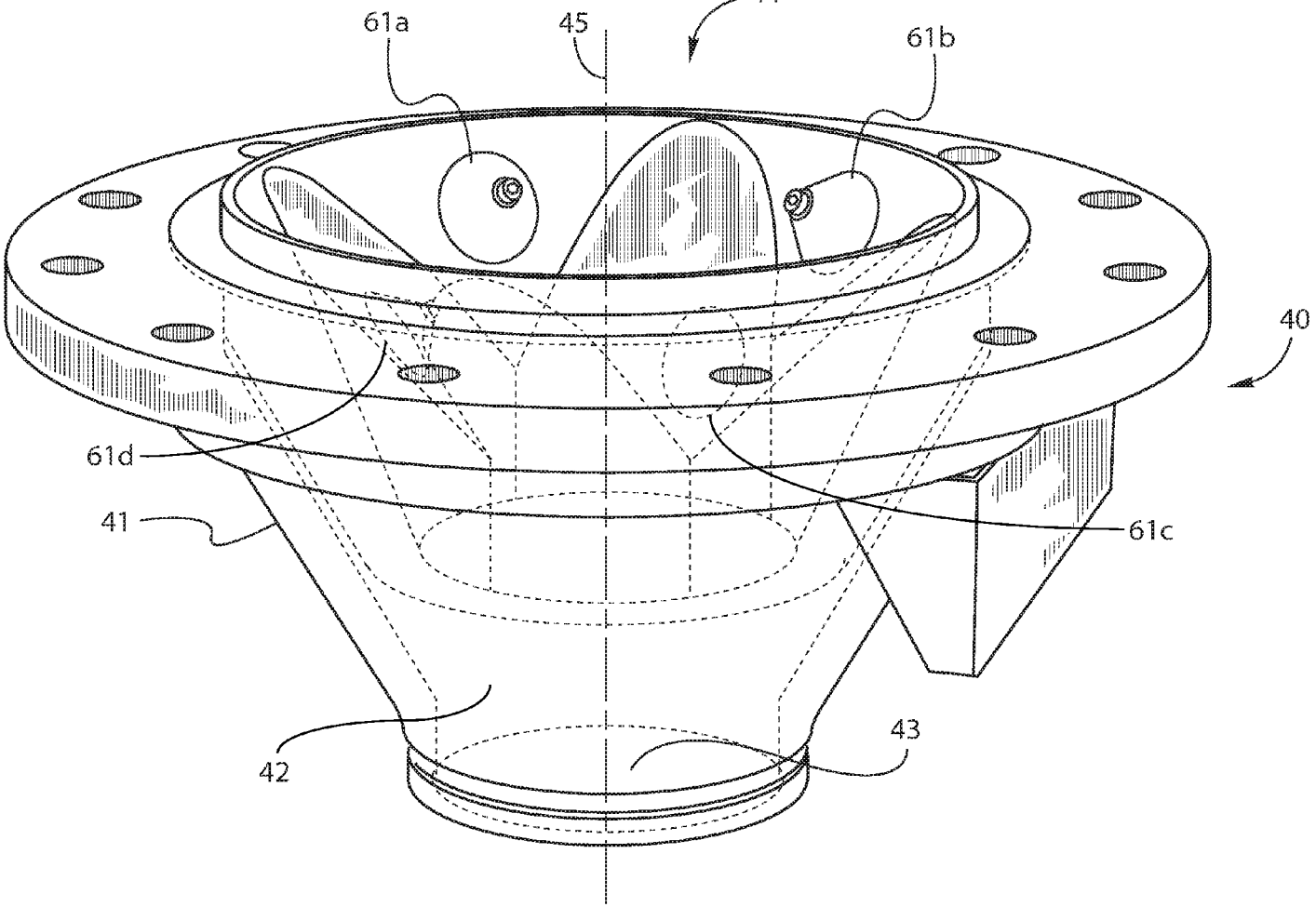
FIG. 3B depicts a top view of a flow promoter with the plurality of fluidizers usable with this method.

FIG. 3B shows a plurality of fluidizers 61*a*, 61*b*, 61*c*, and 61*d*, located in an interior portion of the flow promoter 40.

The discharge segment 39, can be secured to the flow promoter 40. The flow promoter 40 can be a V-slide® manufactured by Vortex Ventures, Inc. from Houston, Tex., with the plurality of fluidizers 61*a*-61*d*, which can be installed thereon.

Figure 3C:
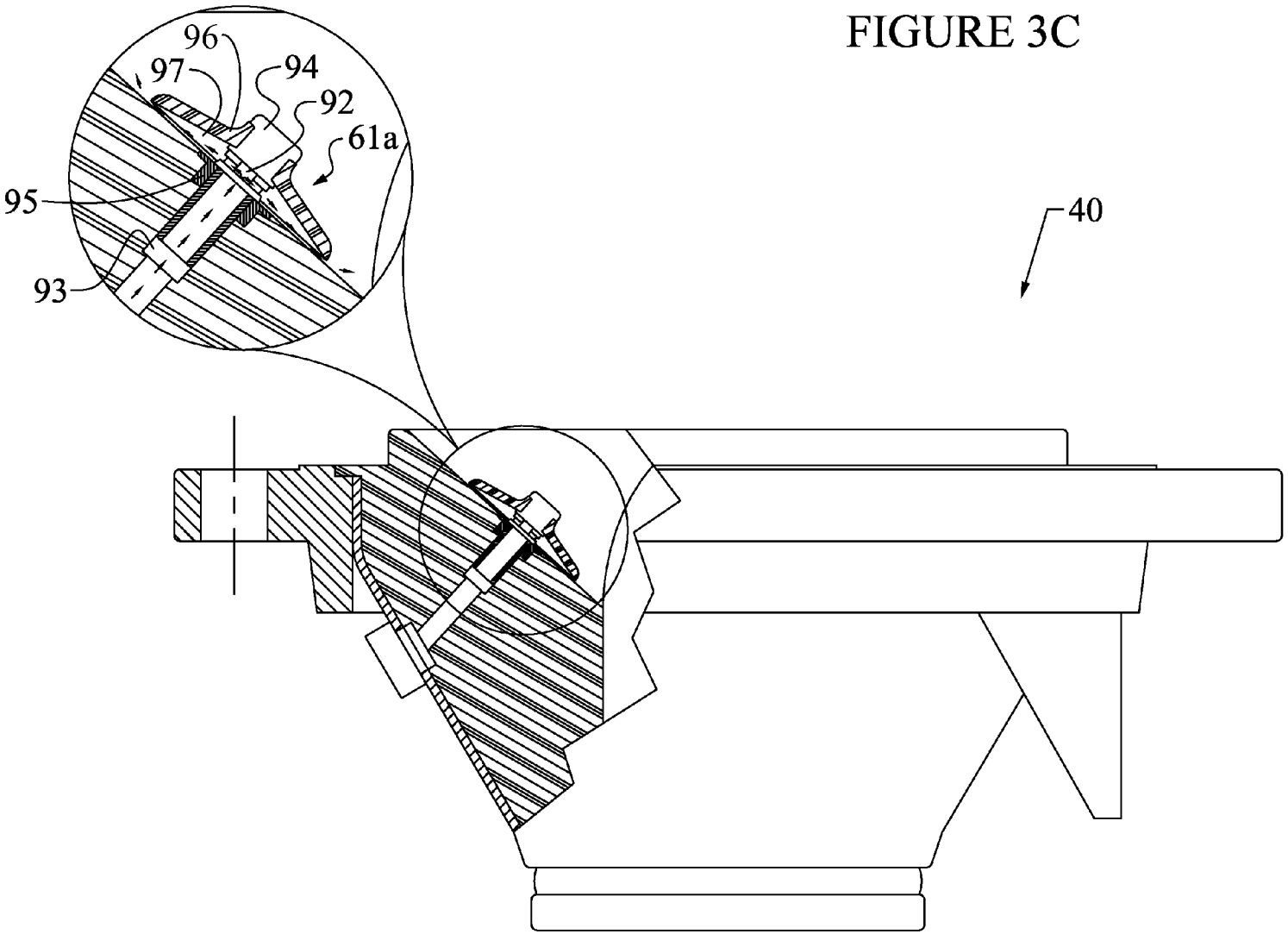
FIG. 3C is a cross-sectional view of one of the plurality of fluidizers of 3B usable with this method.

FIG. 3C depicts a cross sectional view of one of the at least four fluidizers 61*a* of the flow promoter 40. Fluidizer 61*a* is representative of all of the at least four fluidizers 61*a*-61*d*. Fluidizer 61*a* has a stem 93 that is substantially hollow, and a plurality of stem nozzles 92, only one nozzle is shown in this view, for flowing compressed air from the stem 93 to a disc 96. The disc 96 is disposed over the stem 93 forming an air chamber 97, wherein compressed air from the stem 93 lifts the lip of the disc 96. A first fastener 95 secures the fluidizer 61*a* to the flow promoter 40. A second fastener 94 holds the disc 96 over the stem 93.

Figure 4:
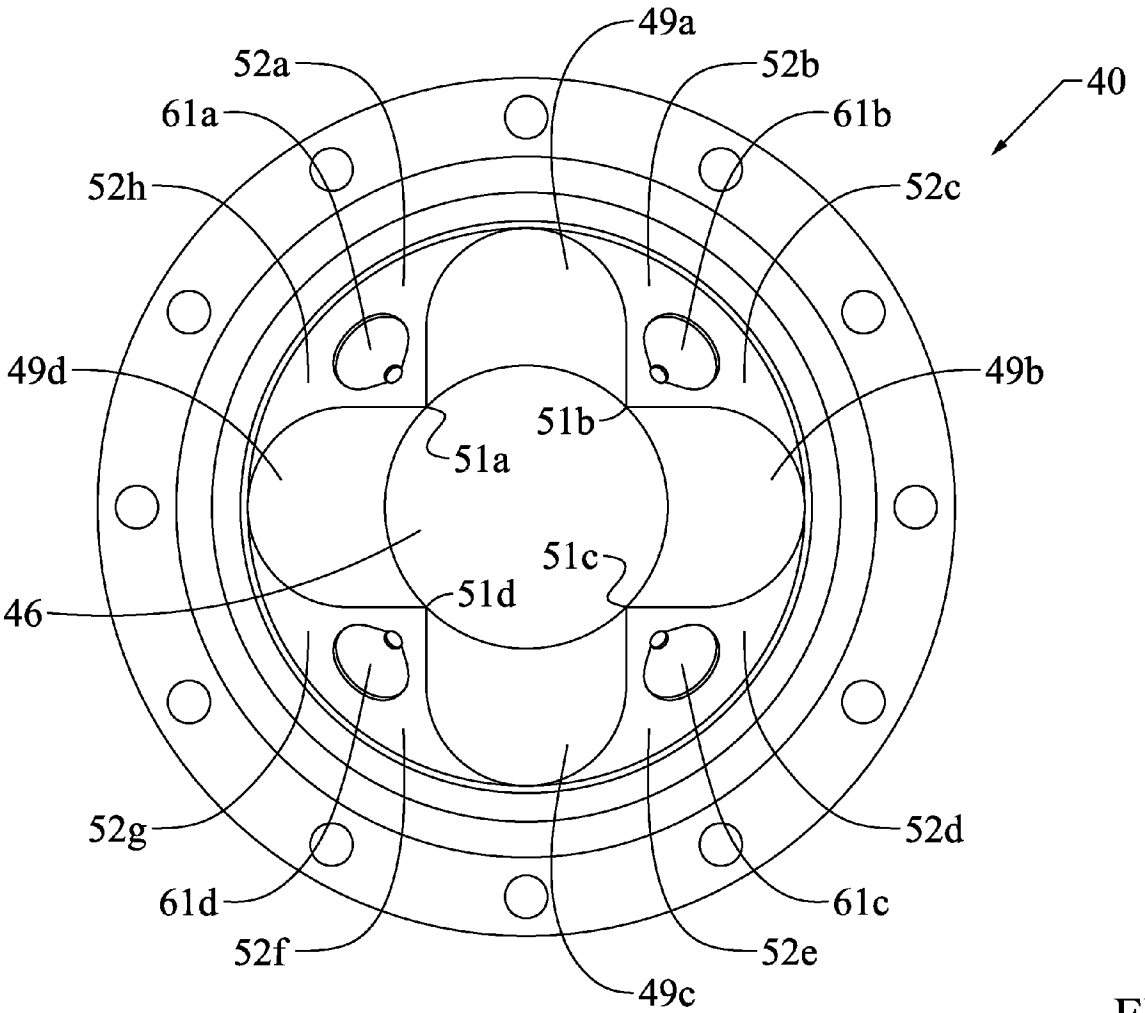
FIG. 4 depicts a top view of a flow promoter usable with the method.

FIG. 4 shows the flow promoter 40 with a cavity core 46 that can have a plurality of lobes 49*a*, 49*b*, 49*c*, 49*d*. Between the plurality of lobes 49*a*-49*d* are a plurality of inlet ridges 51*a*, 51*b*, 51*c* and 51*d*. The plurality of fluidizers 61*a*-61*d* can be installed on the plurality inlet ridges 51*a*-51*d* adjacent the plurality of lobes 49*a*-49*d*. The plurality of inlet ridges 51*a*-51*d* can be include a plurality of sloping walls 52*a*, 52*b*, 52*c*, 52*d*, 52*e*, 52*f*, 52*g*, and 52*h*.

The plurality of sloping walls 52*a*-52*h* can be sufficiently steep and smooth to facilitate the movement of the first dry component 202 to outlet end 43. The shape of the cavity core 46 does not provide sufficient support for the particles to form arches, which could cause bridging, plugging, or rat holing of the first dry component 202.

Figure 5:
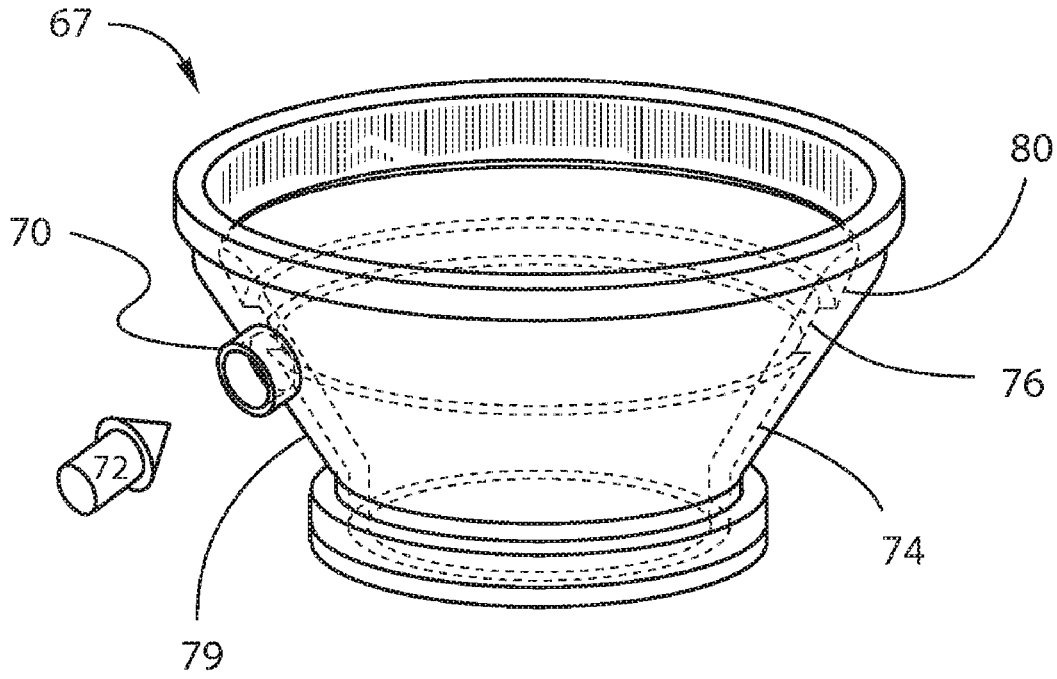
FIG. 5 depicts an embodiment of a fluidizer adapted for use with this method.

FIG. 5 depicts an embodiment of the large fluidizer 67 usable in this method. The large fluidizer 67 is depicted having a concentric reducer housing or outer surface 79 replacing other types of concentric reducer housings. The outer housing 79 can be relatively ridged and can be made from steel, urethane, composites, or other similar materials.

The large fluidizer 67 can have an air supply port 70, such as a half coupling, for receiving pressurized air 72. For example, the pressurized air 72 can be supplied from a compressor connected to the air supply port 70.

The large fluidizer 67 can further have an interior concentric cavity 74. A groove 76 can formed into the outer surface 79 of a flexible fluidizer insert 80. The flexible fluidizer insert 80 can be made of urethane. The outer surface 79 of the large fluidizer 67 can be constructed of metal or an elastomer that is rigid. The groove 76 is depicted at an elevated position relative to the air supply port 70 when the flexible fluidizer insert 80 is slidably disposed within the interior concentric cavity 74.

The pressurized air 72 flows to the groove 76 and causes the flexible fluidizer insert 80 to vibrate and flutter, causing a sheet of air to fluidize the first dry component 202, causing the first dry component 202 to act like a fluid, thereby preventing clogs from dry component clumping.

Figure 6:
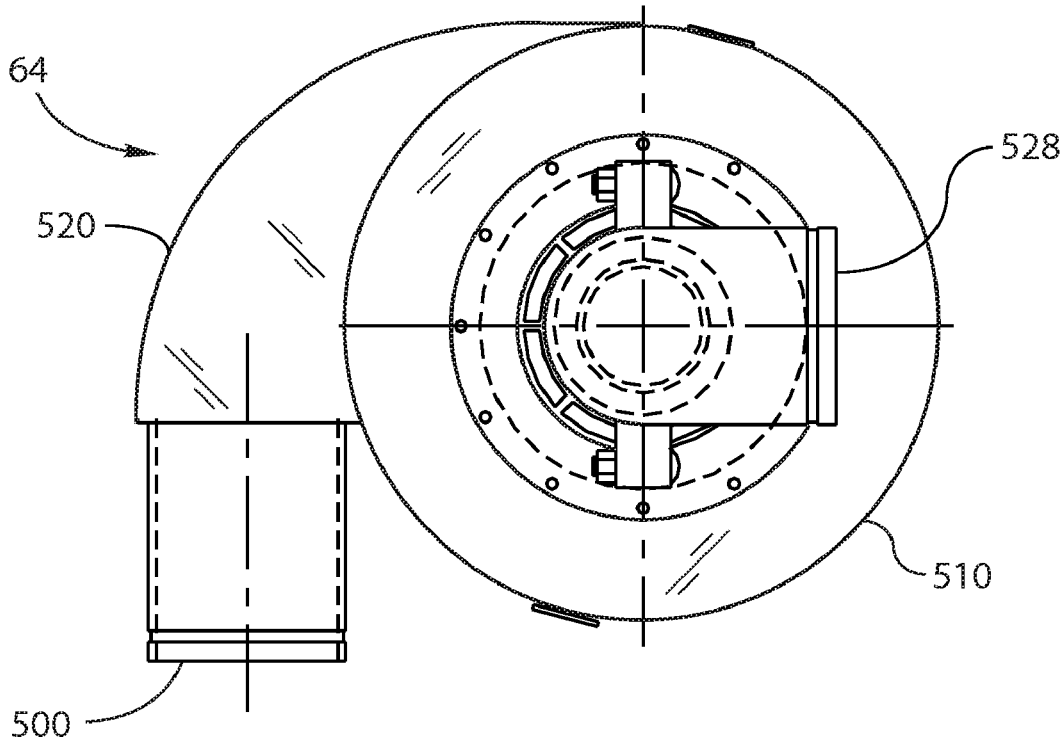
FIG. 6 depicts a top view of an embodiment of a cyclone separator adapted for use with this method.

FIG. 6 depicts a top view of the cyclone separator 64 usable with this method. The cyclone separator 64 is depicted having an outer-housing 510. The outer-housing 510 has a laterally extending entrance opening 500 which can have a rectangular opening for creating a thinner sheet of fluid. An exit 528 is depicted for receiving air containing dust from the vent 3. The cyclone separator 64 centrifugally separates dust solids from expanding air within the surge tank 36 due to pneumatic filling of the surge tank 36.

The entrance opening 500 feeds air to a volute entrance 520 to a cylindrical section of the outer housing 510. The dust entering the volute entrance 520 is directed into a downwardly extending helical path.

Figure 7:
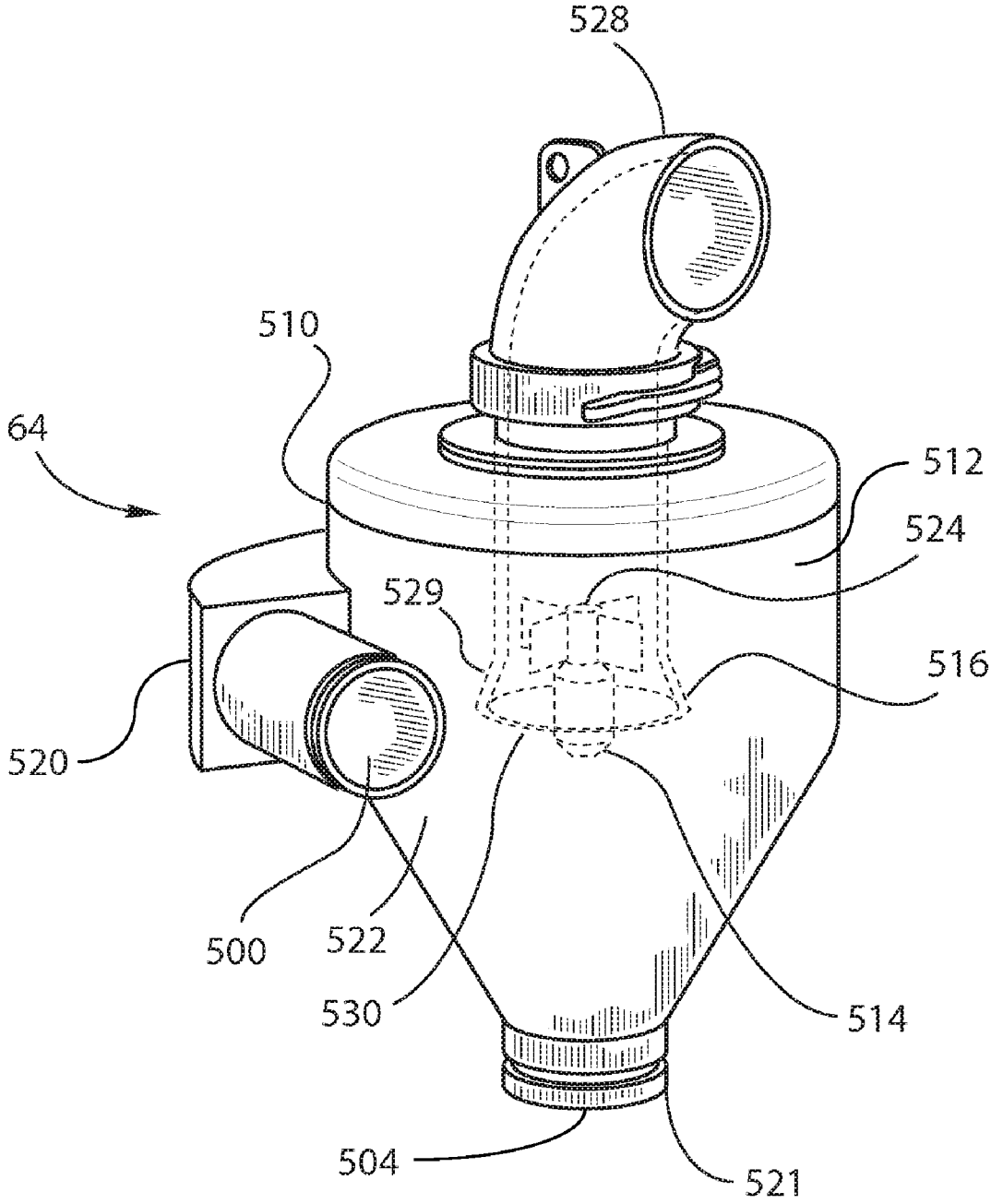
FIG. 7 depicts a side view of an embodiment of a cyclone separator adapted for use with this method.

FIG. 7 depicts a side view of the cyclone separator 64 usable in this method. The cyclone separator 64 is depicted having a cone shape chamber 522.

A vortex finder 524 is depicted suspended from an upper inner housing 512 and extending substantially into the cone shape chamber 522. A stabilizer 514 is secured to the bottom of a vortex finder 524. The vortex finder 524 comprises a fluted inlet 516. The vortex finder 524 has a flared portion 529, which flares or tapers outwardly and defines a lower entrance orifice 530 to the fluted inlet 516.

The outer-housing 510 has a discharge apex 521 defining a circular central region 504 for fluid communication with an induction port, allowing the collected dust to be transported to the eductor 10 for mixing.

Figure 8:
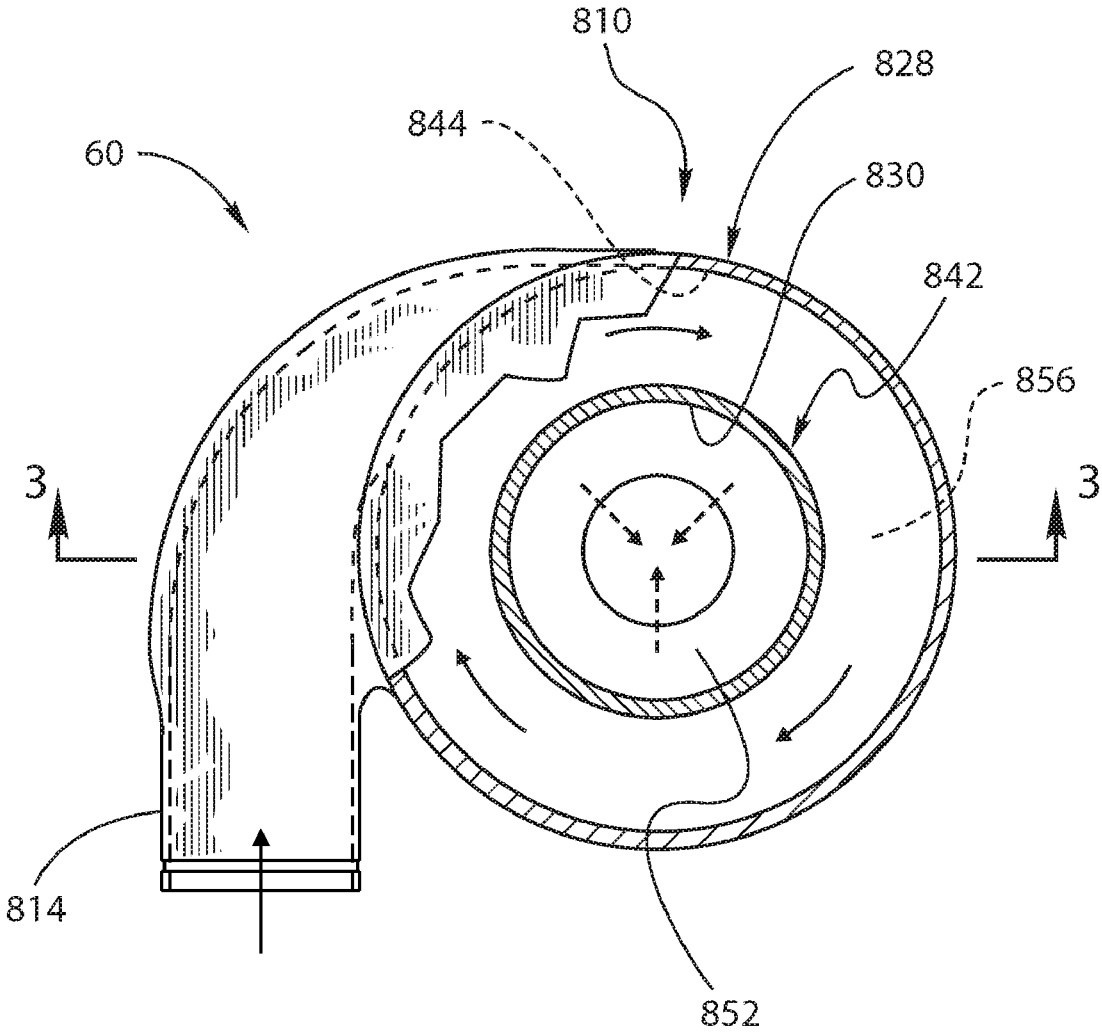
FIG. 8 depicts a top view of an embodiment of a premixer usable with this method.

FIG. 8 is a top view of premixer 60 a usable in an embodiment of the present method. The premixer 60 generates a vortex to pre-wet, disperse, and hydrate the second dry component. A mixing device 810 is depicted. A diverter manifold 814 can be a tubular conduit used in fluid communication with the eductor 10 and the premixer 60, for flowing a portion of the motive pressurized fluid 12 from the eductor 10 to the premixer 60.

The diverter manifold 814 can be tubular with a substantially circular cross section, the inner-diameter of the diverter manifold can be between about 0.5 inches to about 6 inches. A valve, not shown, can be disposed on the diverter manifold 814 for restricting the flow of the motive pressurized fluid through the inner-diameter of the diverter manifold. The premixer 60 provides the benefit of mixing without lumps, "fish eyes", or microgels.

Figure 12:
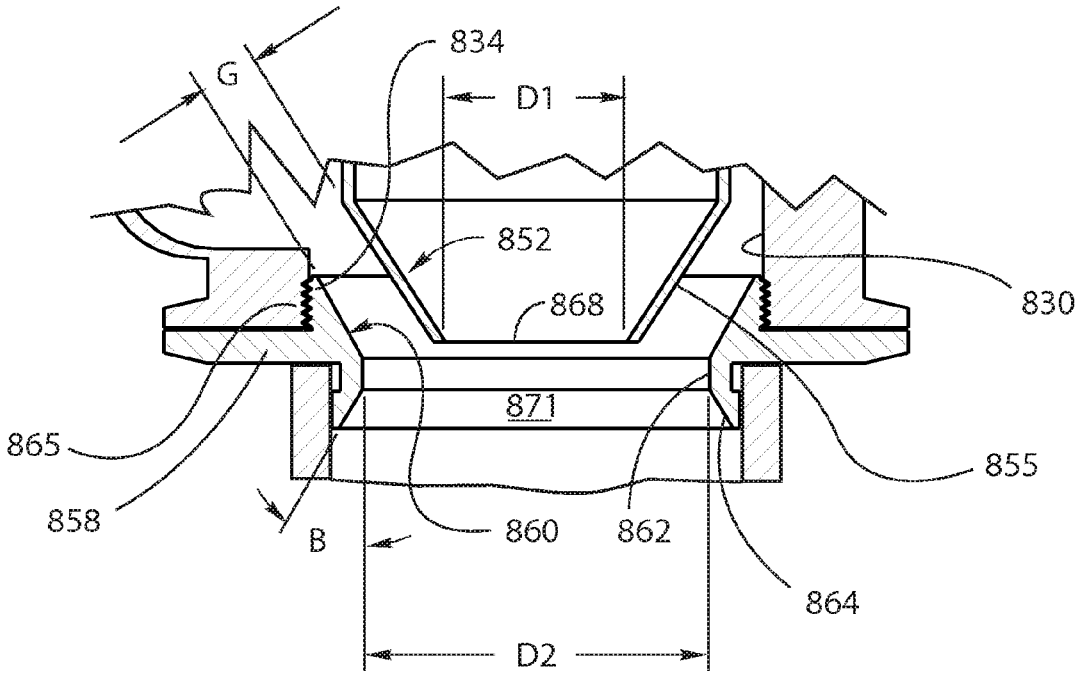
FIG. 12 depicts a further enlarged cross sectional view of the premixer of FIG. 10.

The premixer 60 can include a generally main body or housing 828. The main body 828 defines a generally cylindrical inner surface. A main body 828 has a central bore defined by peripheral surface 830, with an upper portion 865 attachable to a lower portion 834, as shown in FIG. 12, using a fastener. The fastener can be a compression fastener.

The premixer 60 is depicted with an annular nozzle 842, which can receive particulate material from the hopper 75, shown in FIG. 1. Annular nozzle 842 has a nozzle body 844.

The annular nozzle 842 has a diverging section 852 with an annulus disposed between the nozzle body 844 and the diverging section 852.

A vortex chamber can be formed internal to the main body 828 and an annulus 856. The vortex chamber extends between main body 828 and outer surface of the annular nozzle 842.

Figure 9A:
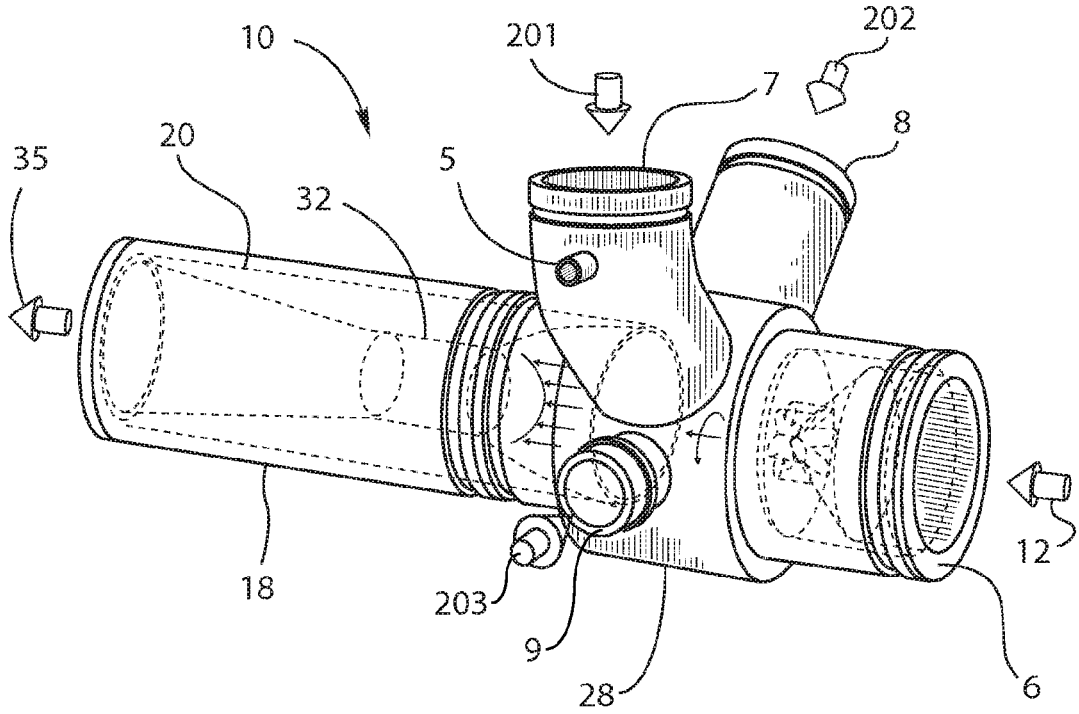
FIG. 9A is a perspective view of an eductor usable in this method.

FIG. 9A is a perspective view of an eductor usable in this method. FIG. 9A shows and eductor 10 with first and second induction ports (7 and 8). Second dry component 201 is depicted entering the first induction port 7. First dry component 202 is depicted entering the second induction port 8. Recovered product 203 is depicted entering eductor 10 through third induction port 9.

A vacuum gauge 5 is depicted in communication with the first induction port 7. It is contemplated that a similar vacuum gauge could be disposed in communication with the second or third induction ports 8 and 9 or combinations thereof, or that there be no vacuum gauge.

FIG. 9A also depicts mixing chamber 28, conical diffuser 20 with a diffuser throat 32, and eductor housing 18.

Motive pressurized fluid 12 is depicted entering an inlet 6 of the eductor 10, while an eductor discharge 35 is depicted exiting the eductor 10.

Figure 9B:
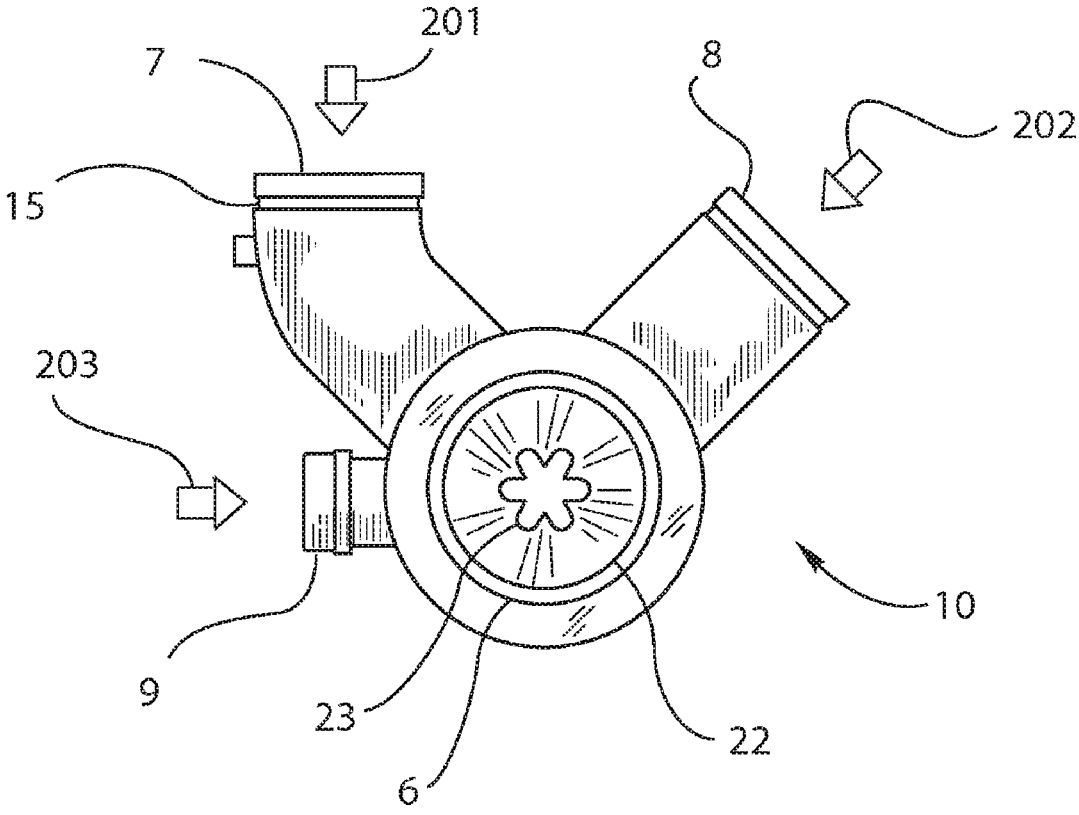
FIG. 9B is a end view of the eductor of FIG. 9A.

FIG. 9B is a end view of the eductor 10 of FIG. 9A. FIG. 9B depicts the first, second, and third induction port 7, 8, and 9. FIG. 9B also depicts the motive nozzle 22 and the lobestar orifice 23.

Second dry component 201 is depicted entering the first induction port 7. First dry component 202 is depicted entering the second induction port 8. Recovered product 203 is depicted entering eductor 10 through third induction port 9.

Figure 10:
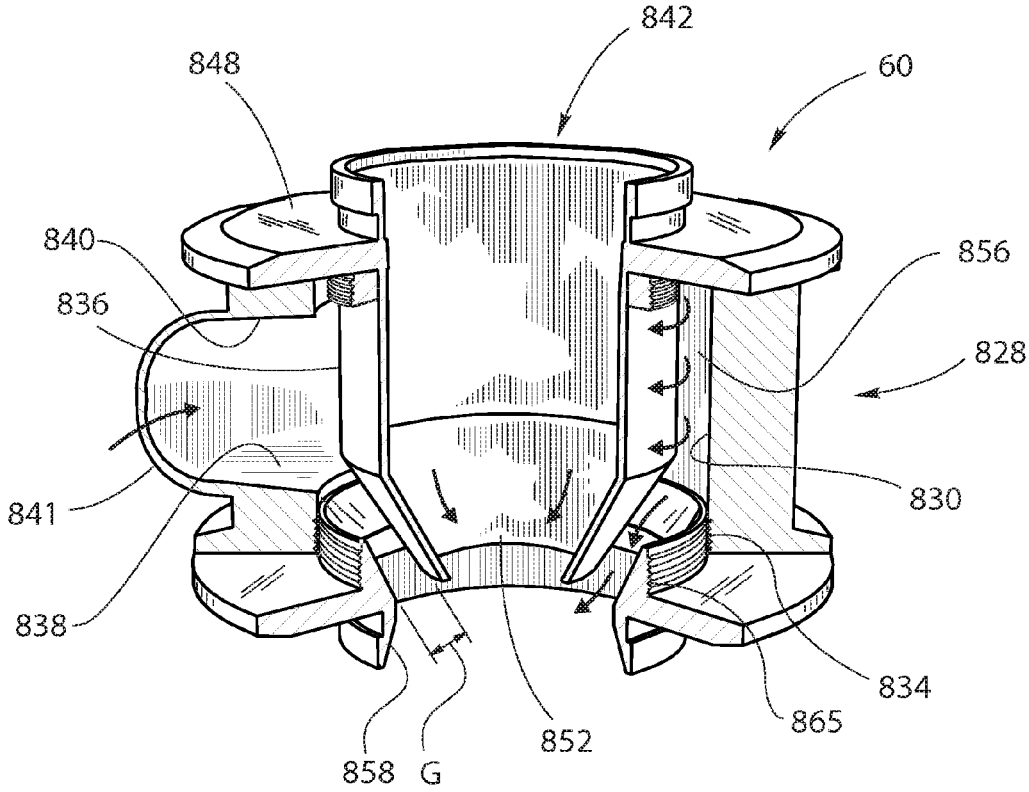
FIG. 10 depicts a cross sectional view of a premixer usable with this method.

FIG. 10 shows a cross sectional view of a premixer 60 usable with this method. A rectangular entrance opening 836 of a rectangular cross section for a liquid is formed between a lower planar ledge 838 and a similar upper planar ledge 840 to form an arcuate surface 841 therebetween, which tapers and merges with peripheral surface 830.

Peripheral surface 830 forms a smooth continuation of arcuate surface 841 and has a lower portion 834 that is attached to upper portion 865

An annular nozzle 842 is disposed in annulus 856, and receives the particulate material from the hopper 75. Annular nozzle 842 has an outer peripheral flange 848.

FIG. 10 also shows a diverging section 852 of the annular nozzle 842, a diffuser ring 858, and that annular nozzle 842 can be secured to the peripheral surface 830 with a fastener, wherein the outer peripheral flange 848 fits against the upper end of the main body 828 in a sealing relation. An annular gap or constriction Gap "G" is also shown.

Figure 11:
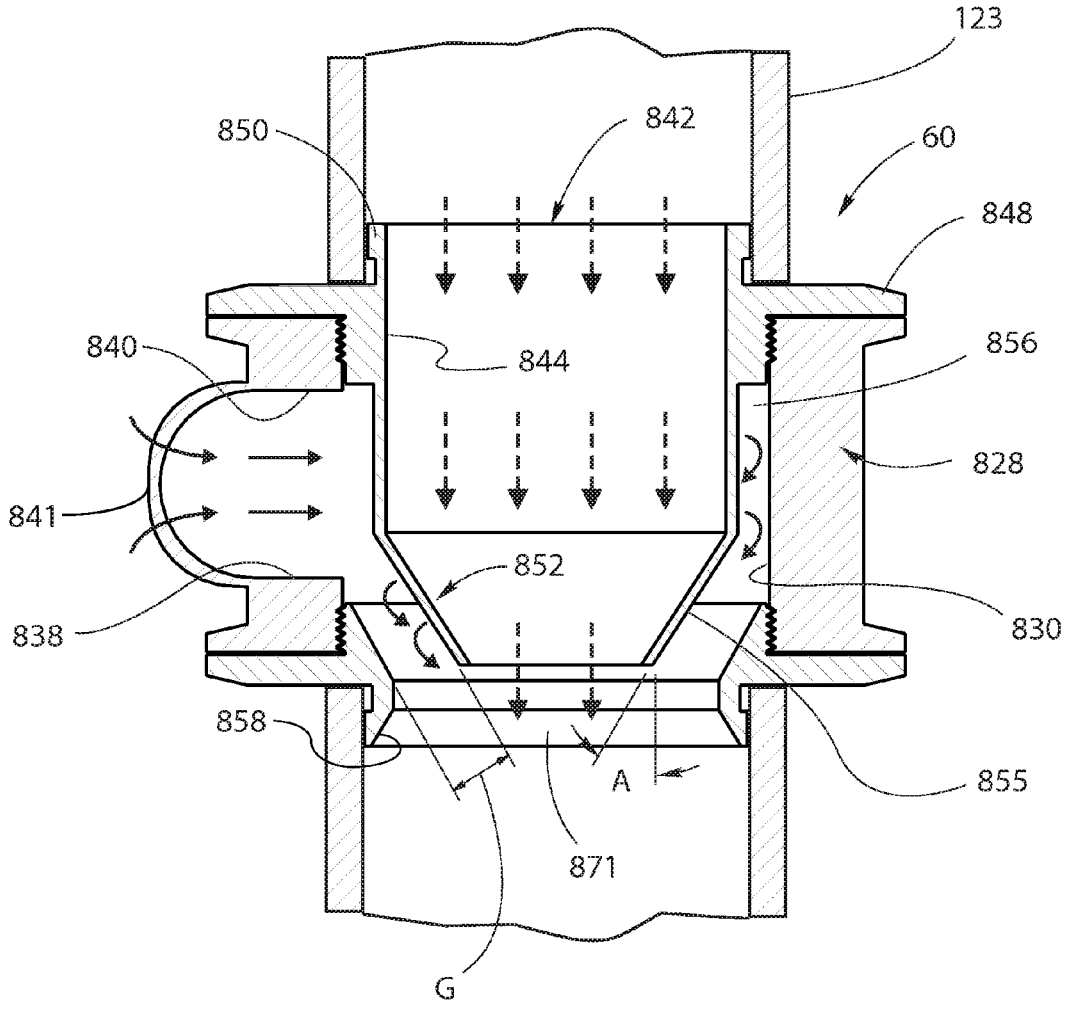
FIG. 11 depicts an enlarged cross sectional view of the premixer of FIG. 10.

FIG. 11, which depicts an enlarged sectional view of the premixer 60 of FIG. 10, shows that conduit 123 extends between the hopper 75 and an upper annular rim 850 of annular nozzle 842. Annular nozzle 842 has a nozzle body 844, the outer peripheral flange 848, and the diverging section 852 with a smooth outer frusto-conical converging surface 855. Since frusto-conical converging surface 855 is smooth, turbulence of the swirling liquid is minimized. Frusto-conical converging surface 855 extends at an angle "A" of about 30 degrees relative to the longitudinal axis of annular nozzle 842. Angle "A" can be between about 10 degrees to about 60 degrees and obtain satisfactory results under various conditions.

Motive pressurized fluid 12 entering the main body 828 from entrance opening 836, as shown in FIG. 10, along arcuate surface 841 descends in a swirling helical path about the annular nozzle 842 in annulus 856 in this method.

For mixing and intermingling of the swirling liquid with the particulate material the particulate material is discharged from the lower end 871 of the annular nozzle 842. A coaxial nozzle can also be used to create this premixer 60.

The diffuser ring 858 is mounted adjacent to the lower end of the main body 828.

FIG. 11 further shows the peripheral surface 830, the upper planar ledge 840, and lower planar ledge 838.

FIG. 12 depicts a further detailed enlarged sectional view of the premixer 60 of FIG. 10. Diffuser ring 858 can have an upper converging section 860 defining the annular nozzle 842, a lower diverging section 864, and a cylindrical throat 862. Lower diverging section 864 can be disposed at an angle "B" relative to the cylindrical throat 862. An annular gap or constriction Gap "G" is formed between the diverging section 852 of the annular nozzle 842 and the diffuser ring 858.

Annular nozzle 842 is depicted having a lower opening 868 with a width of "D1". Lower end 871 is depicted with width "D2".

While these embodiments have been described with emphasis on the embodiments, it should be understood that within the scope of the appended claims, the embodiments might be practiced other than as specifically described herein.

What is claimed is:

1. A dust-free low pressure mixing method for conveying dry components with liquids comprising:

a. conveying at least a first dry component through a hermetically sealed conduit to a surge tank using compressed air;

b. capturing dust from the surge tank using a cyclone separator forming a recovered product and venting air from the cyclone separator;

c. pressurizing an eductor to simultaneously draw at least the first dry component from the surge tank and the recovered product from the cyclone separator into a mixing chamber of the pressurized eductor;

d. using a flow promoter with a plurality of fluidizers to prevent bridging and rat-holing while flowing at least the first dry component to the eductor;

e. fluidizing at least the first dry component and the recovered product using Bernoulli's principle in the eductor, and f. expelling the fluidized at least first dry component and the recovered product from the eductor, forming an eductor discharge.

2. The method of claim 1, further comprising mixing at least a second dry component from a hopper with at least the first dry component and the recovered product in the mixing chamber of the eductor using Bernoulli's principle in the eductor.

3. The method of claim 2, further comprising the step of prewetting at least the second dry component in a premixer as at least the second dry component flows from the hopper to the eductor.

4. The method of claim 2, further comprising flowing the at least first dry component, the recovered product, and the at least second dry component into the eductor simultaneously.

5. The method of claim 2, wherein the hopper is a parabolic or conical hopper with a bag slitter, and wherein a bowl shaped inner cavity of the hopper is in fluid communication with the eductor through the second induction port, thereby allowing the second dry component to flow into the eductor in a substantially dust-free manner.

6. The method of claim 5, further comprising using a roller table with the bag slitter to flow the second dry component into the hopper.

7. The method of claim 2, further comprising pre-mixing at least the second dry component in a premixer prior to introducing the at least second dry component to the mixing chamber.

8. The method of claim 1, wherein the eductor comprises an inlet, a first induction port, a second induction port, and a third induction port, each in fluid communication with the mixing chamber.

9. The method of claim 8, further comprising flowing a motive pressurized fluid into the inlet to generate a low pressure region within the mixing chamber, thereby producing a suction on the first, second, and third induction ports, for drawing in at least the first dry component through the first suction port, for drawing in at least the second dry component through the second induction port, and for drawing in the recovered product through the third induction port, at a flow rate of at least 60 feet per second.

10. The method of claim 1, wherein the plurality of fluidizers in the flow promoter each comprise a stem with a plurality of nozzles for receiving compressed air in fluid communication with a disc having an air chamber for flowing the compressed air from the stem to lift a flexible lip of the disc.

* * * * *